US011466941B2

(12) United States Patent
Dawson

(10) Patent No.: US 11,466,941 B2
(45) Date of Patent: Oct. 11, 2022

(54) FLAT PLATE HEAT EXCHANGER WITH ADJUSTABLE SPACERS

(71) Applicant: Peter Dawson, Okotoks (CA)

(72) Inventor: Peter Dawson, Okotoks (CA)

( * ) Notice: Subject to any disclaimer, the term of this patent is extended or adjusted under 35 U.S.C. 154(b) by 180 days.

(21) Appl. No.: 16/843,533

(22) Filed: Apr. 8, 2020

(65) Prior Publication Data

US 2020/0326144 A1 Oct. 15, 2020

Related U.S. Application Data

(60) Provisional application No. 62/831,455, filed on Apr. 9, 2019.

(51) Int. Cl.

| | |
|---|---|
| ***F28F 13/08*** | (2006.01) |
| ***F28F 9/007*** | (2006.01) |
| ***F28F 3/00*** | (2006.01) |
| ***F28D 9/00*** | (2006.01) |

(52) U.S. Cl.

CPC ..... *F28F 13/08* (2013.01); *F28D 9/0062* (2013.01); *F28F 3/00* (2013.01); *F28F 9/007* (2013.01); *F28F 2230/00* (2013.01)

(58) Field of Classification Search

CPC ... F28D 9/0062; F28F 3/00; F28F 3/10; F28F 9/007; F28F 9/0075; F28F 2230/00; F28F 2280/10; F28F 2280/105

See application file for complete search history.

(56) References Cited

U.S. PATENT DOCUMENTS

| | | | | |
|---|---|---|---|---|
| 4,749,032 A * | 6/1988 | Rosman | F28D 9/0018 165/167 |
| 5,522,462 A * | 6/1996 | Kumar | F28D 9/005 165/166 |
| 6,389,696 B1 * | 5/2002 | Heil | F28D 9/005 165/139 |
| 2004/0069473 A1 * | 4/2004 | Blomgren | F28F 3/04 165/167 |
| 2014/0234507 A1 * | 8/2014 | Cully | F28D 9/0031 426/518 |
| 2014/0311724 A1 * | 10/2014 | Hiwatashi | F28F 3/08 165/166 |
| 2017/0074594 A1 * | 3/2017 | Wollants | F28D 9/0037 |

* cited by examiner

*Primary Examiner* — Eric S Ruppert
*Assistant Examiner* — Hans R Weiland
(74) *Attorney, Agent, or Firm* — Tai W. Nahm; Nahm IP Law

(57) ABSTRACT

There is disclosed a heat exchanger apparatus, comprising flat heat exchange plates positioned parallel to each other, and adjustable spacers provided near each vertical edge of the flat heat exchange plates to form a material flow channel. In an embodiment, each adjustable spacer is configured to be adjustable via one or more angular adjustment mechanisms to form a material flow channel with one of a consistent volume channel, a reducing volume channel, and an increasing volume channel. The adjustable spacers are configured to receive spacer extensions to adjust the width of the spacers. The spacer extensions form extend the face of the spacers with a flat or profiled material contact face.

13 Claims, 6 Drawing Sheets

FLAT PLATE HEAT EXCHANGER WITH ADJUSTABLE SPACERS

FIELD

The present invention relates generally to flat heat exchanger plates for use in heat exchangers, and more particularly, relating to flat heat exchanger plates used in bulk material type heat exchangers.

BACKGROUND

Typically, in processing bulk materials, such as pellets, granules, powders, slurries or the like, heat exchangers are employed to either cool or heat the material during the processing thereof. The heat exchangers employed consist of an array of heat exchanger plates arranged side-by-side in spaced relationship and are positioned in an open top and open bottom housing. The like ends of each heat exchanger plate are connected to together by means of a manifold and a heat exchange medium, such as water, oil, glycol, air, gas or the like is caused to flow through the plates. Generally, the material treated by the heat exchanger is allowed to gravity flow through the housing and the spaces between the spaced plates. During the progression of the material through the heat exchanger, the material is caused to contact the walls of the plates thereby effecting heat transfer between the material and the plates. The rate at which the material flows through the heat exchanger and ultimately across the plates can be controlled by restricting the flow of the material at the outlet of the heat exchanger.

The heat exchanger plates are constructed by attaching metal sheets together along the edges thereof and this is normally accomplished by seam welding the sheets together, and inflating to form a fluid tight hollow plate. Heretofore, heat exchanger plates have been constructed to operate under internal pressure caused by pumping the heat exchange medium through the plate. To resist internal pressure, depressions or dimples, with corresponding inflated pillows and fluid flow diverter seams are formed throughout the plate.

During the normal operation of the heat exchanger the bulk material tends to accumulate within the dimples and the various seam welds and continues to collect to a point where the efficiency of the heat exchanger is greatly reduced and must be cleaned to remove the material residue from these surface deformities throughout the exterior surface of the plates. In some circumstances, the material will bridge between opposing pillows in the spaces between plates; these surface deformations not only reduce the heat transfer efficiency of the heat exchanger, but also restrict or prevent the flow of the material through the heat exchanger. These circumstances are very undesirable because the operation of the heat exchanger must be shut down for a period of time to clean the plates, which many times means the material production line is also shut down, resulting in loss of production and ultimately loss in profits.

Therefore, a need exists for a new and improved flat heat exchanger plate that can be used for bulk material heat exchangers which reduces the tendency for the material to accumulate on the plates.

An illustrative heat exchanger which addresses some of these limitations is disclosed, for example, in U.S. Pat. No. 7,093,649, which issued to the present inventor on Aug. 22, 2006. However, the inventor has recognized a need to make further improvements to the designs.

SUMMARY

The present disclosure describes a novel flat plate heat exchanger having adjustable, smooth spacers which further improve material flow through the heat exchanger.

The heat exchanger apparatus comprises flat heat exchange plates positioned parallel to each other, and the material contact surfaces of the flat plates are substantially smooth and free of depressions, indentations, pillows, ridges or the like to provide an unobstructed flow of materials. Adjustable spacers are provided near each vertical edge of the flat heat exchange plates to form a smooth material flow channel. The spacers are located such that the plate supports and any ledges are removed from the material flow channels.

In an embodiment, each adjustable spacer is configured to be adjustable via one or more angular adjustment mechanisms to form a material flow channel with one of a consistent volume channel, a reducing volume channel, and an increasing volume channel. The adjustable spacers are configured to receive spacer extensions to adjust the width of the spacers for the optimal plate spacing of both material flow and thermal transfer. The spacer extensions extend the face of the spacers with a flat or profiled material contact face.

In another embodiment, the spacers may incorporate a groove to locate mating slide-in or clip-in lateral extension pieces of various widths to create a wider flat or profiled product contact face, thus providing a variable width product flow channel to present the optimal plate spacing.

In an embodiment, plate spacers are provided near the vertical edges of the parallel plates and form a material flow channel having a consistent volume along the vertical length of the material channel. The plate spacers are provided with a means of fastening for installation and an angular adjustment mechanism on at least one end.

In another embodiment, the plate spacers are angled inwardly at their respective bottom edges to form a material flow channel which progressively narrows towards the bottom of the material flow channel. In this embodiment, the material flow channel thus forms a reducing volume channel along its vertical length.

In another embodiment, the plate spacers are angled inwardly at their respective top edges to form a material flow channel which progressively widens towards the bottom of the material flow channel. In this embodiment, the material flow channel thus forms an increasing volume channel along its vertical length.

In another embodiment, the plate spacers have a flat face, which is generally perpendicular to each of the parallel plates and the plate spacers abut on either edge.

In another embodiment, the plate spacers have a profiled angular or concave face which allows an obtuse angle to be formed at the intersection between the parallel plates and the plate spacers, thus allowing materials which are more difficult to handle to flow more freely at the corners or intersection.

In another embodiment, the spacers include profiled sides to form multiple contact points with each of the parallel plates. These spacers with profiled sides may provide a better material seal which allows the heat exchanger to avoid any leakage of materials on either side. These profiled sides can also accommodate a compressible seal.

The spacers and any extension pieces may be formed from an extruded metal or plastic material, or may be fabricated. Different materials may be utilized, and various surface treatments may be applied to the material contact surfaces appropriate for the materials being processed.

Advantageously, the adjustable spacers which allow material to flow through the material flow channel with one of a consistent volume channel, a reducing volume channel, and an increasing volume channel permits that flat plates to be easily reconfigured for different types of materials or changes in material flow characteristics, and to simplify clearing the material flow channel in the event of any upset or during regularly scheduled maintenance.

In all embodiments the spacers can be friction fit between the flat plates and secured, such as shown by way of example in FIG. 7 or as in FIG. 11, by a closure plate or cross-members.

In another embodiment movable side panels will clamp the flat plate/spacer arrangement together in operation. The side panels can be moved apart to facilitate inspection and maintenance.

DETAILED DESCRIPTION

As noted above, the present disclosure relates to a novel flat plate heat exchanger having adjustable spacers which improve material mass flow through the heat exchanger.

As a relevant background discussion on flat heat exchangers, the disclosure of U.S. Pat. No. 7,093,649 is incorporated herein by reference in its entirety. The various heat exchanger embodiments disclosed in this earlier patent document may be modified with the adjustable spacers as herein described, in order to benefit from the further improvements offered by these adjustable spacers.

Figures 1, 2, 3:
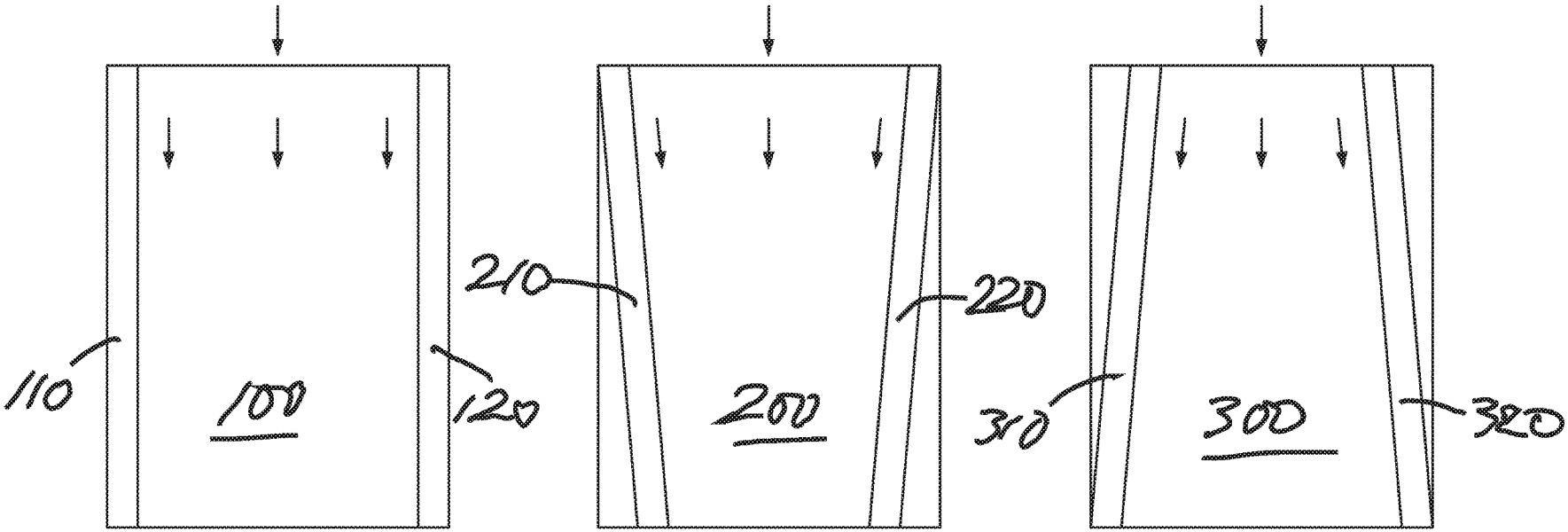
FIG. 1 shows a diagram of a flat plate heat exchanger in accordance with an illustrative embodiment having a consistent volume channel.
FIG. 2 shows a diagram of a flat plate heat exchanger in accordance with another illustrative embodiment having a reducing volume channel.
FIG. 3 shows a diagram of a flat plate heat exchanger in accordance with another illustrative embodiment having an increasing volume channel.

Now referring to FIG. 1, shown is a diagram of a flat plate heat exchanger 100 in accordance with an illustrative embodiment having a consistent volume channel. As illustrated, in this embodiment, both spacers 110, 120 located near the vertical edges of the heat exchange plate are oriented vertically. Materials flowing through this channel will therefore flow through a heat exchanger with a consistent volume along the entire length of the material flow channel.

FIG. 2 shows a diagram of a flat plate heat exchanger 200 in accordance with another illustrative embodiment having a reducing volume channel defined by spacers 210, 220. In order to better control the flow of materials through the heat exchange channel, a material flow channel which reduces in volume towards the bottom will tend to slow down the flow of materials.

FIG. 3 shows a diagram of a flat plate heat exchanger 300 in accordance with another illustrative embodiment having an increasing volume channel defined by spacers 310, 320. In order to avoid the tendency of some materials to compact during material flow, the increasing volume of the channel steadily reduces this tendency in order to maintain mass-flow conditions.

Figure 5:
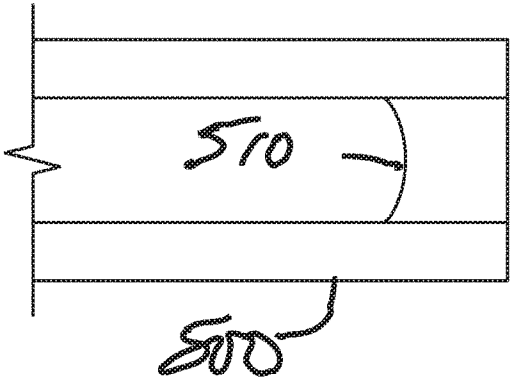
FIG. 5 shows a diagram of a spacer having a concave profiled face.
Figure 4:
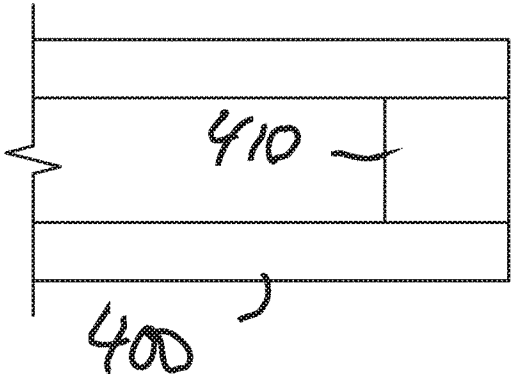
FIG. 4 shows a diagram of a spacer having a flat face.

Now referring to FIG. 4, shown is a diagram of a spacer 400 having a flat face 410. This flat face may be suitable for many applications in which the materials tend to flow freely. However, FIG. 5 and FIG. 8 show diagrams of spacers 500, 800 having profiled faces 510, 810 which may be more suitable for materials with higher fluid viscosity or less free-flowing particulate flow characteristics.

Figure 6:
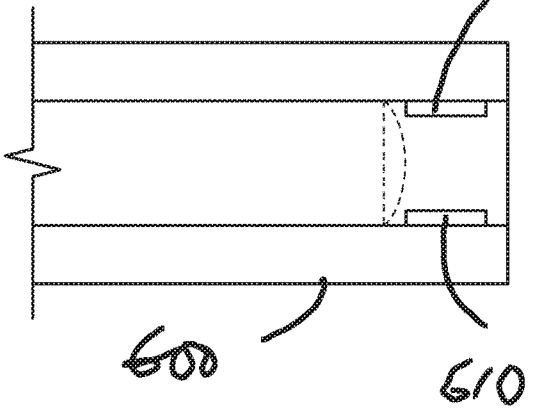
FIG. 6 shows a diagram of a spacer including profiled sides to provide multiple contact points with the parallel plates.

FIG. 6 shows a diagram of a spacer 600 including profiled sides to provide multiple contact points with the parallel plates. In an embodiment, the profiled sides may form a channel for receiving spacer extensions or compressible seals as described further below with respect to FIG. 8.

Figure 7:
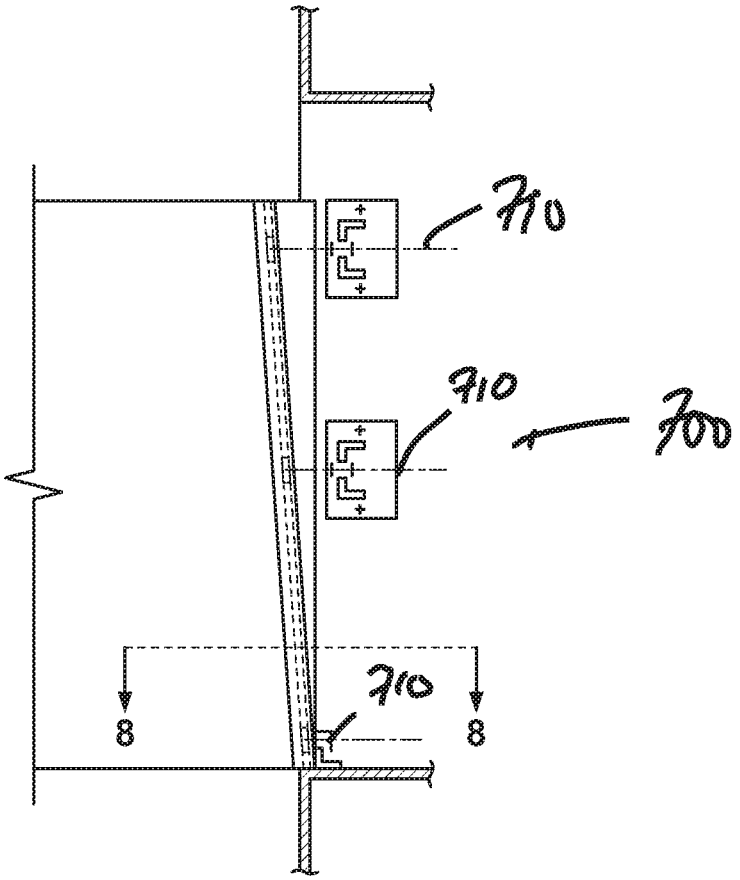
FIG. 7 shows a diagram of an illustrative spacer angled in accordance with an increasing volume channel, showing a plurality of fastener slots for fastening the spacer at various locations.

Now referring to FIG. 7, shown is a diagram of an illustrative spacer 700 angled in accordance with an increasing volume channel, showing a plurality of fasteners 710 for fixing the spacer at various locations. As shown, various fastening points may be located at different positions of the spacer, including a fastening point at a lower end which affixes the spacer at a fixed point. A fastening point located near the top of the spacer may be coupled to an angular adjustment mechanism which can be used to angle the spacer inwardly near the top end, such that the heat exchanger forms an increasing volume channel as previously shown in FIG. 3. The spacer may also include other fastening points near the middle of the spacer, to provide additional mechanical support or reinforcement to keep the spacer aligned.

Figure 8:
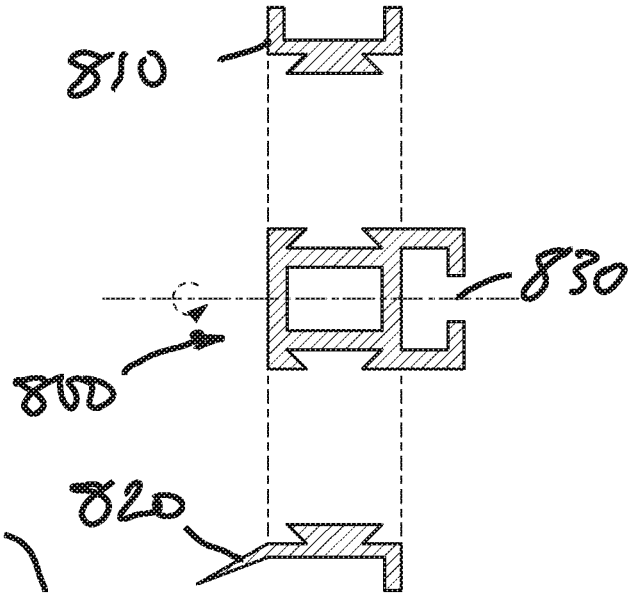
FIG. 8 shows a diagram of a spacer with optional extension attachments.

Now referring to FIG. 8, shown is a diagram of a spacer 800 with optional extension attachments 810, 820. In an embodiment, a combination of attachments 810, 820 can be manufactured with the spacer 100 as a one piece extrusion. While the spacer 800 as shown in the middle of FIG. 8 with a flat face may be utilized on its own, the spacer may also receive extensions 810, 820 on one or both sides. For example, an extension piece 810 shown above the main spacer is a flat extension piece which may be coupled to the main spacer via a dovetail joint. Alternatively, a profiled extension 820 such as the extension shown below the main spacer may provide an angled surface at a corner of the spacer which meets one of the flat plates. Compressible seals can be applied to these alternatives.

Still referring to FIG. 8, a fastener slot 830 is shown to the right side of the spacer which may be used as a fastening point, as previously discussed with respect to FIG. 7.

Figure 9:
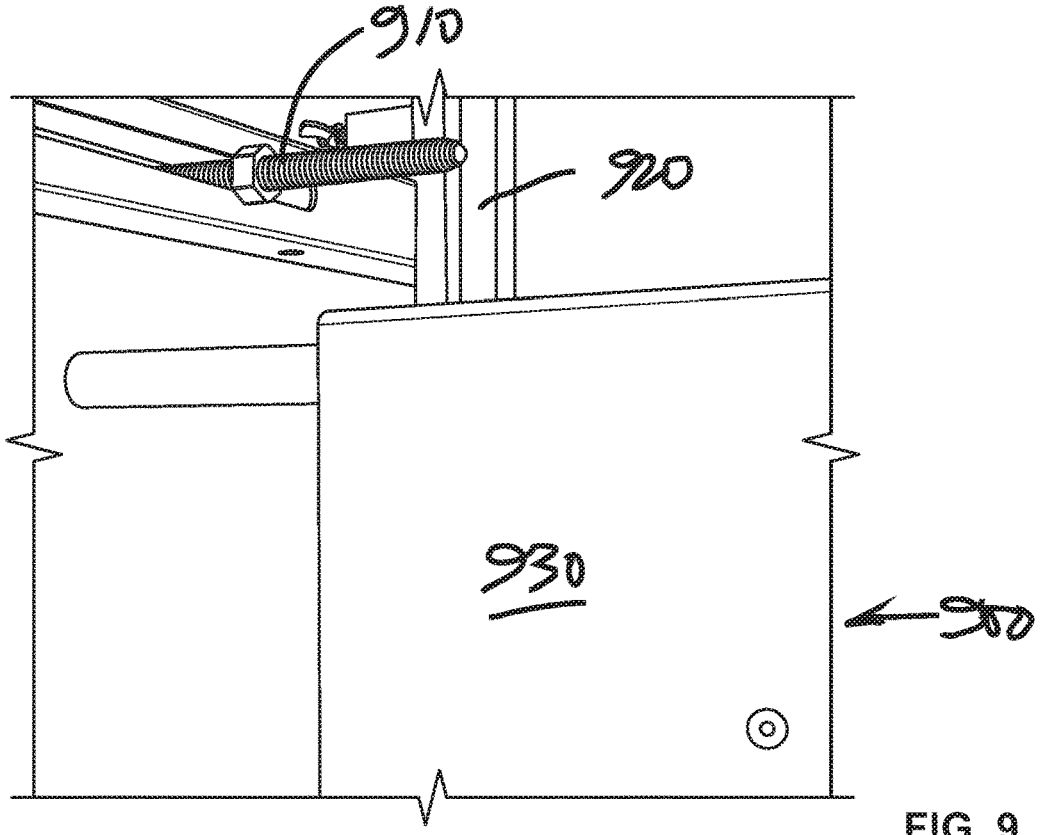
FIG. 9 shows a photograph of an angular adjustment mechanism in accordance with an illustrative embodiment.

Now referring to FIG. 9, shown is a diagram of an angular adjustment mechanism 910 in accordance with an illustrative embodiment. The angular adjustment mechanism in this case is a threaded rod which is fastened to a point near the top of a spacer 920. While a threaded rod has been shown by way of example, it will be appreciated that other mechanical or electro-mechanical mechanisms to control the relative position of the spacer and the angle formed by the spacer may also be used.

Figure 10:
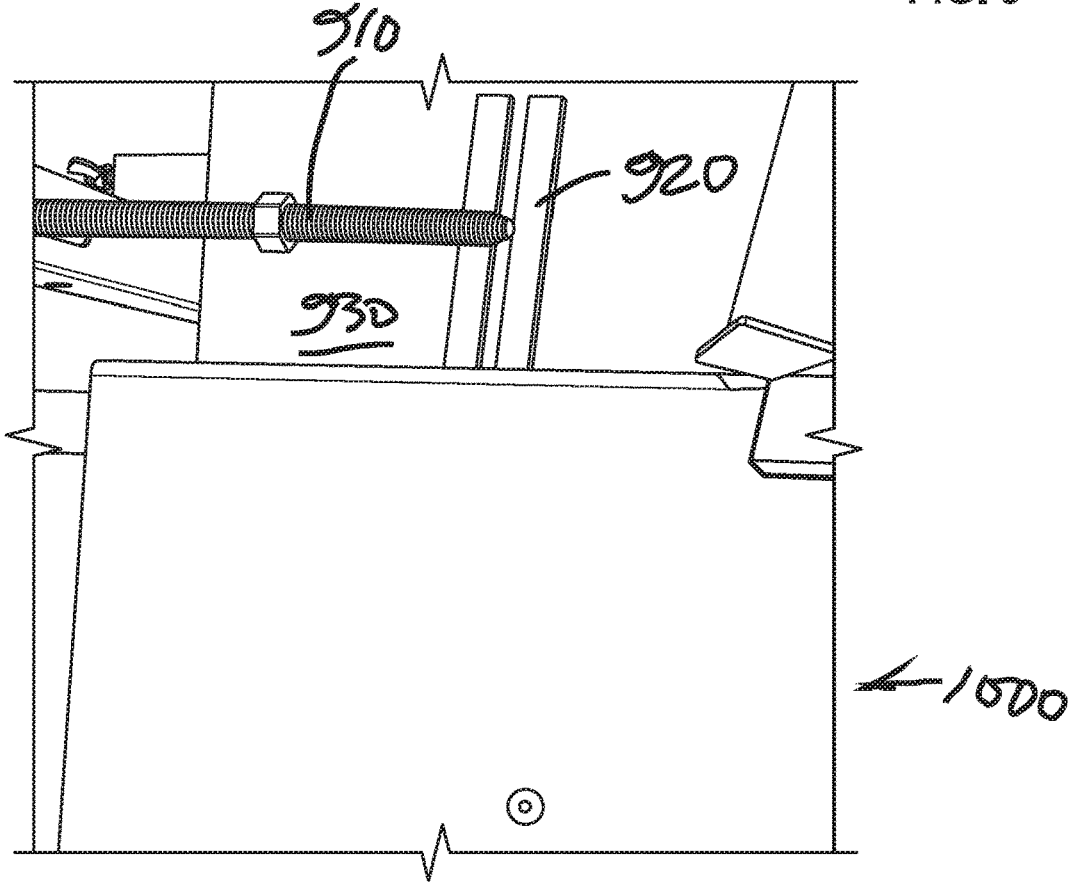
FIG. 10 shows a photograph of the angular adjustment mechanism of FIG. 9 having moved the adjustable spacer inwardly, as an illustrative example.

In FIG. 9, the spacer 920 is oriented in a generally vertical position. FIG. 10 shows a diagram of the angular adjustment mechanism of FIG. 9 having moved the adjustable spacer 920 inwardly, such that the adjustable spacer 920 is now forming an angle relative to the heating plate 930, as shown for example in the configuration in FIG. 3 and in FIG. 7. As will be appreciated, a similar angular adjustment mechanism may be fastened to a lower end of the spacer 920 to achieve the adjustment shown in FIG. 2.

Generally, the optimal spacer width and angular setting will be established during prior material flow testing—i.e. using the flow test unit of FIG. 9 and FIG. 10. Therefore, further angular or width adjustment of the spacers 920 may not be deemed a requirement in the supplied heat exchanger. In this case, the spacers can be located accordingly without means of adjustment, i.e. the adjustment is pre-determined and incorporated in the design of the heat exchanger.

Figure 11:
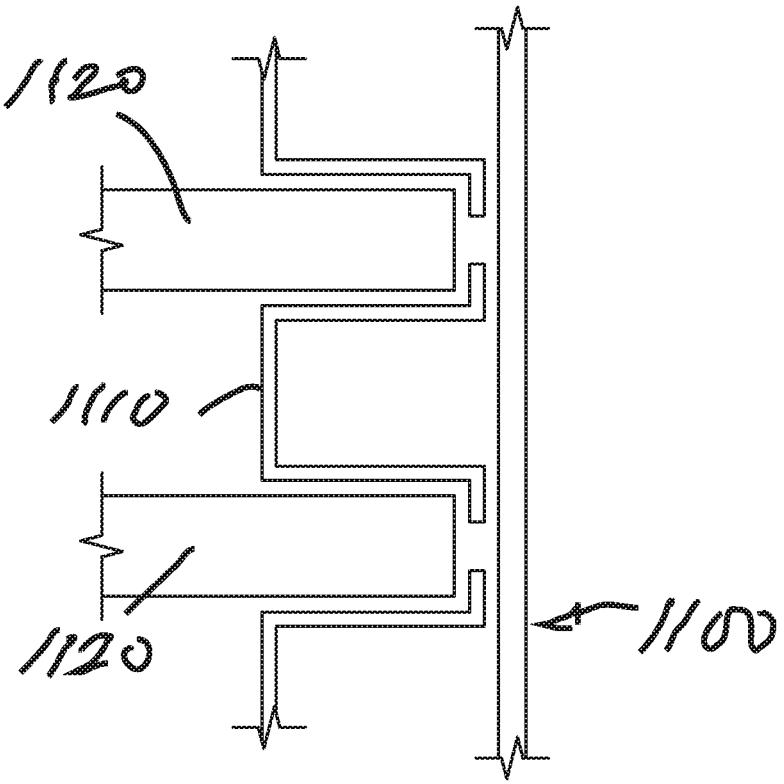
FIG. 11 shows an illustrative example of spacers held in place by a closure panel or removable cross-members in accordance with an embodiment.
Figure 12:
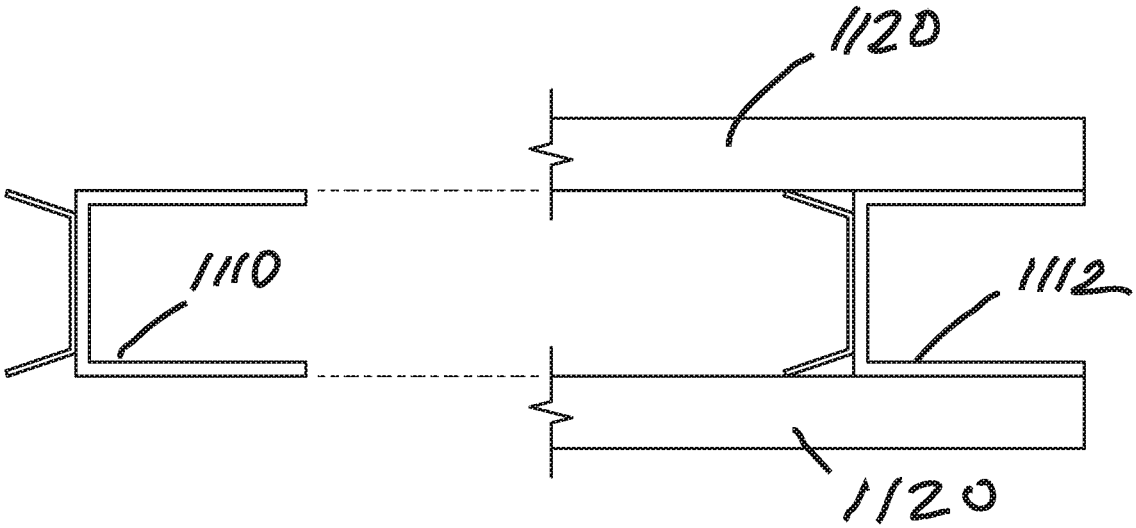
FIG. 12 shows an example of a fabricated spacer of pre-determined width fitted with a flexible seal. The flexible seals will more readily conform to the flat plate manufacturing tolerances. Other seal formations and materials can be used.
Figure 13:
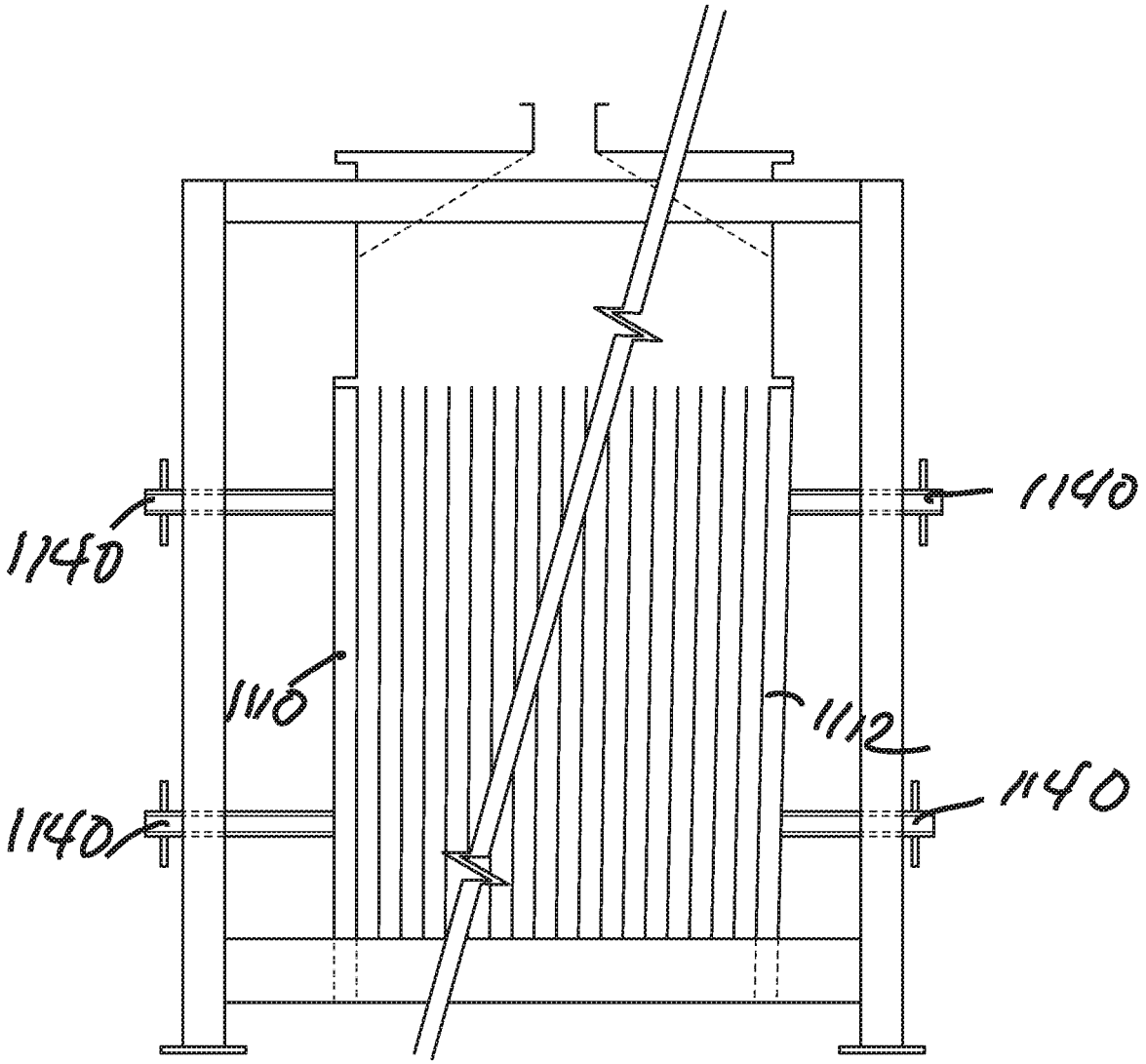
FIG. 13 is an end elevation of a heat exchanger of this application and shows the flat plates and spacers clamped together by movable end panels for operating conditions. The side panels can be moved apart to release the assembly for inspection and maintenance.

FIGS. 11 to 13 show an illustrative example 1100 of fabricated spacers 1110, 1112 of pre-determined width between flat plates 1120 held in place by a closure panel or removable cross-members.

In an embodiment, both top and bottom ends of the spacers 1110, 1112 may each be fastened to angular adjustment mechanisms 1140, such that both ends of spacers 1110 and 1112 may be adjusted to achieve any one of the configurations shown in FIG. 1, FIG. 2 and FIG. 3.

As will be appreciated, by allowing the spacers to be adjustable to form a flat plate heat exchanger with a material flow channel with one of a consistent volume channel, a reducing volume channel, and an increasing volume channel, the heat exchanger may be readily modified and reconfigured for different types of materials that flow through the heat exchanger. This may assist with better material flow through the material flow channel, clearing the material flow channel in the event of any blockage, or cleaning the material flow channel during regularly scheduled maintenance.

Thus, in an aspect, there is provided a heat exchanger apparatus, comprising: flat heat exchange plates positioned substantially parallel to each other; and adjustable spacers provided near each vertical edge of the flat heat exchange plates to form a material flow channel; wherein, each adjustable spacer is configured to be adjustable via one or more angular adjustment mechanisms to form a material flow channel with one of a consistent volume channel, a reducing volume channel, and an increasing volume channel.

In an embodiment, the adjustable spacers have settings which are pre-determined.

In another embodiment, the adjustable spacers are configured to receive spacer extensions to adjust the width of the spacers.

In another embodiment, the spacer extensions extend the face of the spacers with a flat or profiled material contact face.

In another embodiment, the spacers include a groove to locate mating slide-in or clip-in lateral extension pieces of varying widths, thereby to create a wider flat or angled product contact face to provide a variable width product flow channel.

In another embodiment, the spacers are provided near vertical edges of the parallel plates and form a material flow channel having a consistent volume along the vertical length of the material channel, the plate spacers having a fastener slot for installation and an angular adjustment mechanism on at least one end.

In another embodiment, the plate spacers are angled inwardly at their respective bottom edges to form a material flow channel which progressively narrows towards the bottom of the material flow channel.

In another embodiment, the plate spacers are angled inwardly at their respective top edges to form a material flow channel which progressively widens towards the bottom of the material flow channel.

In another embodiment, the plate spacers have a flat face which is generally perpendicular to each of the parallel plates and the plate spacers abut on either edge.

In another embodiment, the plate spacers have a profiled angular or concave face which allows an obtuse angle to be formed at an intersection between the parallel plates and the plate spacers, thereby allowing materials to flow more freely at corners or an intersection.

In another embodiment, the spacers include profiled sides to form multiple contact points with each of the parallel plates.

In another embodiment, the profiled sides are configured to accommodate a compressible seal.

In another embodiment, the spacers comprise an extruded metal or plastic material.

In another embodiment, the spacers comprise a fabricated arrangement.

In another embodiment, the spacers include surface treatments appropriate for a type of material flowing through the heat exchanger.

While illustrative embodiments have been described above by way of example, it will be appreciated that various changes and modifications may be made without departing from the scope of the system and method, which is defined by the following claims.

The invention claimed is:

1. A heat exchanger apparatus for bulk materials, comprising:

flat heat exchange plates oriented vertically and positioned substantially parallel to each other; and adjustable spacers provided near each vertical edge of the flat heat exchange plates to form a vertically oriented bulk material flow channel;

wherein, each adjustable spacer is configured to be adjustable via one or more angular adjustment mechanisms to form a vertically oriented bulk material flow channel having a volume adjustable anywhere between reducing to consistent to increasing, thereby to control the gravity flow of bulk materials through the vertically oriented bulk material flow channel, and facilitate first-in, first-out material mass flow.

2. The heat exchange apparatus of claim 1, wherein the adjustable spacers have settings which are pre-determined.

3. The heat exchange apparatus of claim 1, wherein the adjustable spacers are configured to receive spacer extensions to adjust the width of the spacers.

4. The heat exchange apparatus of claim 3, wherein the spacer extensions extend the face of the spacers with a flat or profiled material contact face.

5. The heat exchange apparatus of claim 1, wherein the spacers include a groove to locate mating slide-in or clip-in lateral extension pieces of varying widths, thereby to create a wider flat or profiled product contact face to provide a variable width product flow channel.

6. The heat exchange apparatus of claim 1, wherein the plate spacers are angled inwardly at their respective bottom edges to form a material flow channel which progressively narrows towards the bottom of the material flow channel.

7. The heat exchange apparatus of claim 1, wherein the plate spacers are angled inwardly at their respective top edges to form a material flow channel which progressively widens towards the bottom of the material flow channel.

8. The heat exchange apparatus of claim 1, wherein the plate spacers have a flat face which is generally perpendicular to each of the parallel plates and the plate spacers abut on either edge.

9. The heat exchange apparatus of claim 1, wherein the plate spacers have a profiled angular or concave face which allows an obtuse angle to be formed at an intersection between the parallel plates and the plate spacers, thereby allowing materials to flow more freely at corners or an intersection.

10. The heat exchange apparatus of claim 1, wherein the spacers include profiled sides to form multiple contact points with each of the parallel plates.

11. The heat exchange apparatus of claim 10, wherein the profiled sides are configured to accommodate a compressible seal.

12. The heat exchange apparatus of claim 1, wherein the spacers comprise an extruded metal or plastic material.

13. The heat exchange apparatus of claim 1, wherein the spacers comprise a fabricated arrangement.

* * * * *